US007201670B2

(12) United States Patent
Ninomiya et al.

(10) Patent No.: US 7,201,670 B2
(45) Date of Patent: Apr. 10, 2007

(54) GOLF BALL AND MOLD FOR MANUFACTURING CORE THEREOF

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation, Osaka-shi (JP)

( * ) Notice: Subject to any disclaimer, the term of this patent is extended or adjusted under 35 U.S.C. 154(b) by 9 days.

(21) Appl. No.: 10/902,077

(22) Filed: Jul. 30, 2004

(65) Prior Publication Data

US 2005/0054463 A1 Mar. 10, 2005

(30) Foreign Application Priority Data

Aug. 1, 2003 (JP) ..... 2003-285046

(51) Int. Cl.
*A63B 37/06* (2006.01)

(52) U.S. Cl. ..... 473/374

(58) Field of Classification Search ..... 473/374, 473/373

See application file for complete search history.

(56) References Cited

U.S. PATENT DOCUMENTS

| | | | | |
|---|---|---|---|---|
| 1,182,604 | A | 5/1916 | Wadsworth | |
| 1,855,448 | A | 4/1932 | Hazeltine | |
| 5,820,485 | A * | 10/1998 | Hwang | 473/361 |
| 5,984,807 | A * | 11/1999 | Wai et al. | 473/376 |
| 6,213,893 | B1 * | 4/2001 | Maruko et al. | 473/370 |
| 6,293,877 | B1 * | 9/2001 | Boehm | 473/371 |
| 6,398,667 | B1 | 6/2002 | Lemons | 473/374 |
| 6,503,155 | B2 * | 1/2003 | Maruko et al. | 473/370 |
| 2002/0086746 | A1 * | 7/2002 | Bellinger et al. | 473/374 |
| 2003/0022731 | A1 * | 1/2003 | Jordan et al. | 473/351 |

FOREIGN PATENT DOCUMENTS

| | | |
|---|---|---|
| JP | 60-241463 | 11/1985 |
| JP | 2000-84120 | 3/2000 |
| JP | 2003-24472 | 1/2003 |

OTHER PUBLICATIONS

Non-English language publication w/Japanese version of Search Report dated Sep. 21, 2004.

* cited by examiner

*Primary Examiner*—Raeann Gorden
*Assistant Examiner*—Raeann Trimiew
(74) *Attorney, Agent, or Firm*—Armstrong, Kratz, Quintos, Hanson & Brooks, LLP

(57) ABSTRACT

A golf ball comprising a core (1), intermediate layer (3), and cover (5), wherein the intermediate layer (3) is provided with a plurality of apertures through which the core (1) is exposed, wherein the outer surface of the intermediate layer (3) and the surface of the core (1) exposed through the apertures are on substantially the same spherical surface, and wherein the hardness of the intermediate layer (3) is greater than that of the core (1). The golf ball achieves both a high ball resilience and a soft impact feel.

7 Claims, 7 Drawing Sheets

(a)

(b)

GOLF BALL AND MOLD FOR MANUFACTURING CORE THEREOF

TECHNICAL FIELD

The present invention relates to a so-called multi-piece golf ball composed of a plurality of layers and a mold for manufacturing the core thereof.

BACKGROUND ART

Recently, several proposals for golf balls exhibiting both a high ball resilience and a soft impact feel have been proposed. Representative examples thereof include so-called three-piece golf balls comprising a core, an intermediate layer and a cover, and development thereof has been actively pursued. For example, the specification of U.S. Pat. No. 6,398,667 discloses a three-piece golf ball wherein the intermediate layer is formed into a lattice structure using a hard material and a cover is provided thereon. In this structure, because the cover is covered with a hard intermediate layer, deformation of the core when impacted by a golf club is prevented, thus achieving a high ball resilience.

In the golf ball disclosed in the above publication, a portion of the inner surface of the cover extends to the core through an aperture in the lattice of the intermediate layer and reaches the surface of the core. Therefore, of the inner surface of the cover, some portion contacts the intermediate layer and some portion contacts the core. This renders a problem such that thick and thin portions coexist in the same cover, and when the thick portion is hit, the impact feels hard. As a result, the hardness is uneven depending on the portion hit, and a uniform impact feel cannot be obtained.

DISCLOSURE OF THE INVENTION

The present invention aims to solve the above drawbacks and provide a golf ball having both a high ball resilience and a soft impact feel, and a mold for manufacturing the core of such a golf ball.

A golf ball of the present invention solves the above drawbacks and comprises a core, an intermediate layer and a cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core.

In this structure, a soft core having a low hardness is covered with an intermediate layer having a hardness greater than the core, with some portions of the core being exposed through a plurality of apertures formed in the intermediate layer. Therefore, the following effects can be attained. Because the soft core is covered with the intermediate layer having a hardness greater than the core, an excessive degree of deformation of the core when hit is prevented by the intermediate layer. As a result, the ball resilience is improved. Further, because a portion of the soft core reaches the inner surface of the cover through the apertures of the intermediate layer, it is possible to obtain a soft impact feel.

Furthermore, because in this golf ball, the core and the intermediate layer are on substantially the same spherical surface, the thickness of the cover provided thereon is substantially uniform over any point of the spherical surface. Therefore, it is possible to prevent an uneven impact feel attributable to thick and thin portions coexisting in the same cover as in the prior art examples. Having the above structure, the golf ball of the present invention can achieve both a high ball resilience and a soft impact feel.

The intermediate layer may be of one of various modes, for example, it is possible to form the intermediate layer by placing a material having a hardness greater than the core in concave portions formed in the surface of the core. It is preferable that the plurality of apertures formed in the intermediate layer be arranged point symmetrically relative to the center of the core. Having this structure makes it possible to obtain a uniform impact feel regardless of which portion of the ball surface is hit. As an example, it is possible to form the intermediate layer in the following manner. The intermediate layer may comprise bands having substantially the same width that extend along three great circles intersecting each other at right angles on the surface of the core, with the apertures being formed into a triangular shape by being surrounded by the bands.

The core may be of one of various modes; however, it is preferable that, for example, when any plane that passes one of the great circles of the core is defined, the surface of the core with which the intermediate layer is in contact extend perpendicular to the plane or outward in the radial direction as it approaches the plane. This structure makes it possible to easily remove the core from the mold, when the mold that can be split in half by the above-described plane is used. Therefore, it is possible to reduce production time and prepare the mold at low cost. As a result, production costs can be reduced.

An example of a core that can be easily removed from a mold is as follows. The surface of the core comprises eight first surfaces exposed through the apertures, and twelve second surfaces extending between intersections of the three great circles, wherein each first surface is formed into a regular triangular shape bounded by arcs having substantially the same length, each second surface extending between intersections of the great circles has the same radius of curvature as the arcs, and two of the second surfaces meet each other at an intersection at right angle and have a boundary between the first surface along a line from the intersection to an apex of a first surface nearest to the intersection.

In the golf ball, to reliably obtain a soft impact feel, it is preferable that the hardness of the cover be not greater than that of the intermediate layer and greater than that of the core. It is also possible to make the hardness of the cover less than that of the core. Such a structure further increases soft impact feel and improves spin performance.

It is also preferable that the thickness of the thickest portion of the intermediate layer be 1.0 to 1.7 mm. Furthermore, at the spherical surface including the intermediate layer surface, it is preferable that the proportion of the area of the core exposed through the apertures be 10 to 50%.

A mold for manufacturing a core as described above having a polyhedral-shape may have the following structure. A mold comprises an inner surface corresponding to the surface of the core, and a parting line on a plane passing along any one of the three great circles.

A golf ball of the present invention can achieve a high ball resilience and a soft impact feel.

BEST MODE FOR CARRYING OUT THE INVENTION (First Embodiment)

Figure 1:
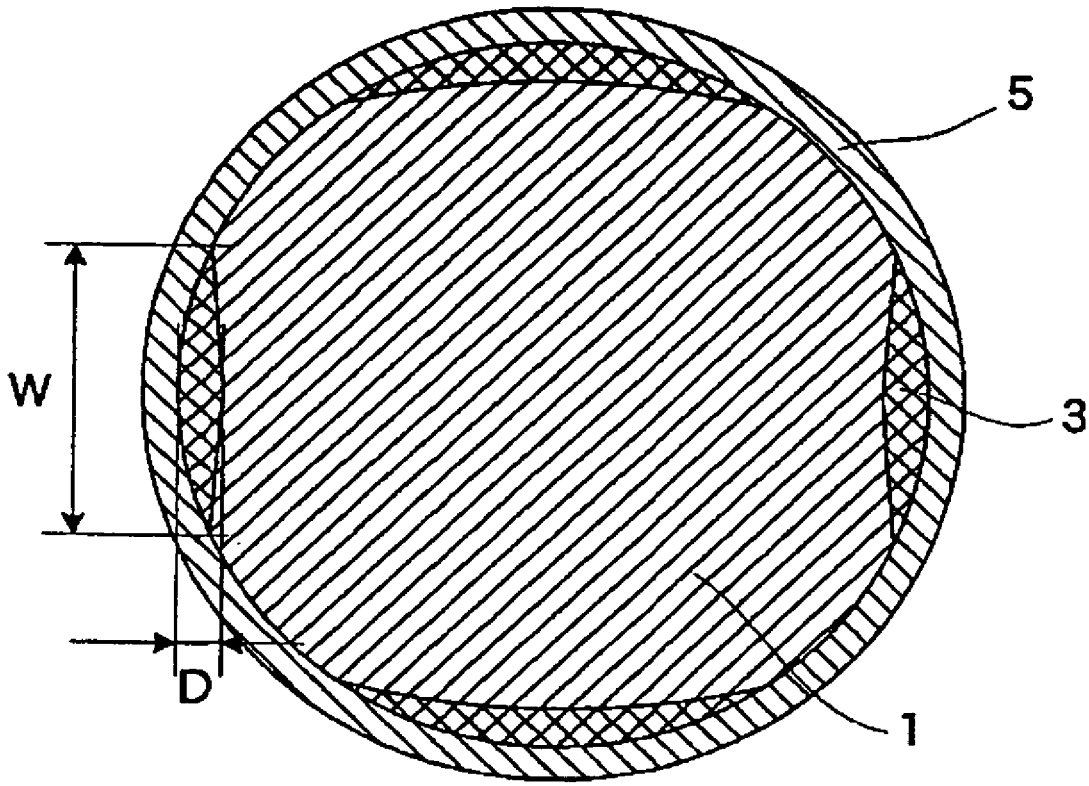
FIG. 1 is a cross-sectional view showing a golf ball according to the first embodiment of the present invention.

Hereunder, a golf ball of a first embodiment of the present invention is explained. FIG. 1 is a cross-sectional view of a golf ball of the present invention.

As shown in FIG. 1, the golf ball of the present embodiment is a so-called three-piece golf ball comprising a core 1, an intermediate layer 3, and a cover 5 covering the core 1 and the intermediate layer 3. According to the rules (see R&A and USGA), the diameter of a golf ball should be no smaller than 42.67 mm. However, taking aerodynamic characteristics and the like into consideration, it is preferable that the diameter of the ball be as small as possible. Therefore, it can be, for example, 42.7 mm.

Figure 2:
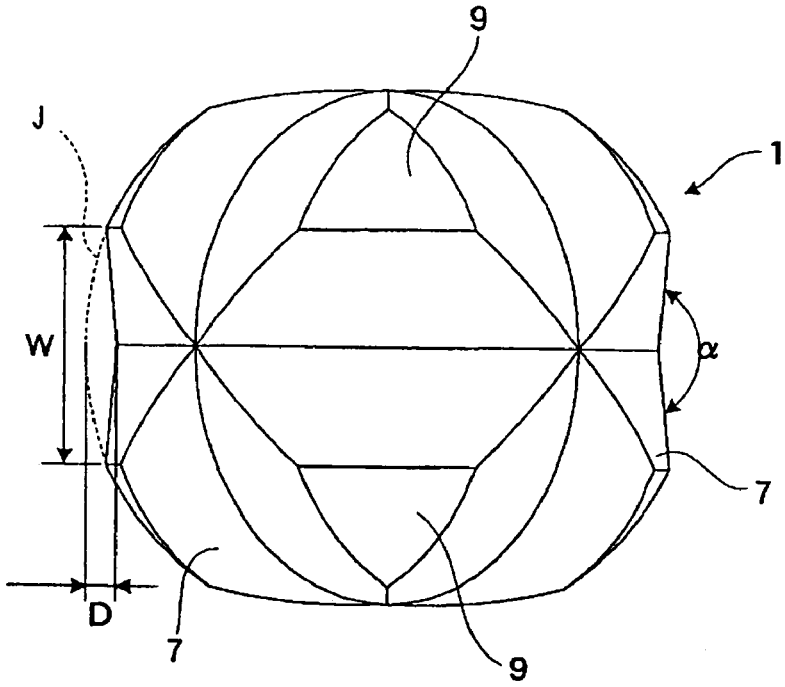
FIG. 2 is a front view of the core of the golf ball shown in FIG. 1.

FIG. 2 is a front view of the core. The core 1 is spherically shaped as shown in the figure, and is composed of a rubber composition. It is preferable that the maximum diameter of the core 1 be in the range of from 37.5 to 40.5 mm, and more preferably from 38.7 to 39.5 mm. This is because, when the maximum diameter of the core is smaller than 37.5 mm, the thickness of the cover 5 described later is large, which hardens the impact feel. On the other hand, when the maximum diameter of the core is larger than 40.5 mm, the ball resilience and durability are reduced. It is preferable that the core 1 have a Shore D hardness of from 35 to 55. The maximum diameter of the core 1 is defined as the core diameter measured in a portion (region 9) where no grooves described as below are formed.

On the surface of the core 1, grooves (concave portions) 7 each having a V-shaped cross-sectional profile wherein the angle $\alpha$ is acute are formed along three great circles drawn on the surface of the core 1 so as to intersect each other at right angles. On the surface of the core 1, eight triangular-shaped regions 9 surrounded by the grooves 7 are formed. It is preferable that the depth D of the groove 7, i.e., the distance from the virtual surface (the dotted line J in FIG. 2) which has the maximum diameter of the core 1 to the deepest portion of the groove in the radial direction, be 1.0 to 1.7 mm. The proportion of the area of the regions 9 to the spherical surface including the regions 9 is preferably 10 to 50%. Therefore, it is preferable that the width W and the angle $\alpha$ of the groove 7 be selected in such a manner that the proportion of the area of the regions 9 falls within the above range. The reasons for this will be explained later.

Core 1 may be formed from known rubber compositions containing base rubbers, cross-linking agents, metal salts of unsaturated carboxylic acids, fillers, etc. Natural rubber, polyisoprene rubber, styrene-butadiene rubber, ethylene-propylene-diene monomer (EPDM) and the like may be used as base rubbers. However, it is preferable to use a high-cis polybutadiene that contains 40% or more cis-1,4-bonds and preferably 80% or more.

Specific examples of cross-linking agents include dicumyl peroxide, t-butylperoxide and like organic peroxides, and it is particularly preferable to use dicumyl peroxide. The compounding ratio of the cross-linking agent is generally 0.3 to 5 parts by weight, and preferably 0.5 to 2 parts by weight, based on 100 parts by weight of base rubber.

It is preferable to use monovalent or divalent metal salts of acrylic acid, methacrylic acid and like $C_3$ to $C_8$ unsaturated carboxylic acids as metal salts of unsaturated carboxylic acids. Among these, use of zinc acrylate can improve the ball resilience and is particularly preferable. The compounding ratio of unsaturated carboxylic acid metal salt is preferably 10 to 40 parts by weight, based on 100 parts by weight of base rubber.

Fillers those generally added to the core 1 are also usable. Specific examples thereof include zinc oxide, barium sulfate, calcium carbonate, etc. The preferable compounding ratio of filler is 2 to 50 parts by weight, based on 100 parts by weight of base rubber. If necessary, it is also possible to add antioxidants, peptizers and the like.

Other than the above-mentioned rubber compositions, it is also possible to use known elastomers as a material for the core 1.

Figure 3:
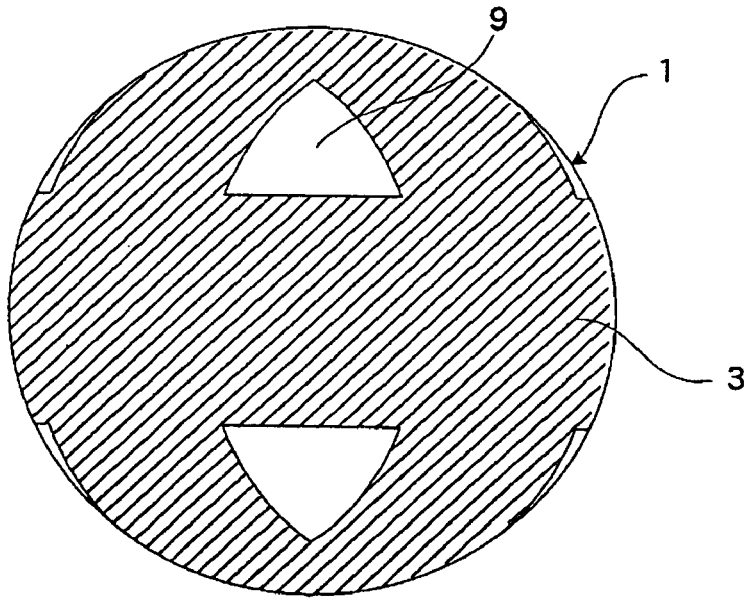
FIG. 3 is a front view showing an unfinished product comprising an intermediate layer covering the core shown in FIG. 1.

FIG. 3 is a front view showing an unfinished product wherein an intermediate layer is formed on the core 1. The intermediate layer 3 is formed from an elastomer, placed in the grooves 7 of the core 1 as shown in FIG. 3, and defined by bands extending along the great circles. In this structure, the surface of the intermediate layer 3 and the surface of the core 1 exposed through the intermediate layer 3, i.e., the surface of the above described regions 9, are on substantially the same spherical surface. Therefore, the thickness and width of the intermediate layer 3 coincide the depth D and width W of the grooves 7 of the core 1. The hardness of the intermediate layer 3 is greater than that of the core 1, preferably a Shore D hardness of from 60 to 70.

The reason it is preferable that the proportion of the area of the regions 9 be 10 to 50% is that when its proportion is smaller than 10%, the proportion occupied by the hard intermediate layer 3 is too large and this hardens the impact feel; on the other hand, when its proportion is greater than 50%, the proportion occupied by the intermediate layer 3 is too small, and deformation of the core 1 cannot be satisfactorily prevented and the ball resilience is reduced. The reason the depth of the groove 7 is set at from 1.0 to 1.7 mm is as follows: When the depth of the groove 7 is less than 1.0 mm, the thickness of the hard intermediate layer 3 is small and this reduces the ball resilience and makes molding difficult. When the depth of the groove 7 exceeds 1.7 mm, the hard intermediate layer 3 is thick and this hardens the impact feel. In the intermediate layer 3, the portions through which the core 1 is exposed, i.e., the portions in which the regions 9 are exposed, correspond to the apertures in the present invention.

Examples of elastomers usable for forming the intermediate layer 3 include styrene-butadiene-styrene block copolymers (SBS), styrene-isoprene-styrene block copolymers (SIS), styrene-ethylene-butylene-styrene block copolymers (SEBS), styrene-ethylene-propylene-styrene block copolymers (SEPS) and like styrene-based thermoplastic elastomers; olefin-based thermoplastic elastomers having polyethylene or polypropylene as a hard segment and butadiene rubber or ethylene-propylene rubber as a soft segment; vinyl chloride-based thermoplastic elastomers having crystallized poly(vinyl chloride) as a hard segment and amorphous poly(vinyl chloride) or an acrylonitrile butadiene rubber as a soft segment; urethane-based thermoplastic elastomers having polyurethane as a hard segment and polyether or polyester as a soft segment; polyester-based thermoplastic elastomers having polyester as a hard segment and polyether or polyester as a soft segment; amide-based thermoplastic elastomers having polyamide as a hard segment and polyether or polyester as a soft segment; ionomer resins, etc.

The cover 5 is formed from elastomer as the intermediate layer 3 and, as shown in FIG. 1, covers the surface of the core 1. Predetermined dimples (not shown) are formed on the surface of the cover 5. As described above, because portions of the core 1 are exposed through the intermediate layer 3, the cover 5 is in contact with the core 1 in these portions. The hardness of the cover 5 is less than that of the intermediate layer 3 and greater that that of the core 1. It is preferable that the cover 5 have a Shore D hardness of 40 to 65. The thickness of the cover 3 is preferably 1.1 to 2.6 mm and more preferably 1.4 to 2.0 mm. This is because, when the thickness of the cover 5 is less than 1.1 mm, the durability of the cover 3 is significantly reduced and molding becomes difficult. On the other hand, when the thickness of the cover 5 exceeds 2.6 mm, impact feels hard. The thickness of the cover 5 is defined as the distance from any point of its outermost portion where no dimples are formed to a point that contacts the core 1 in the radial direction. Elastomers for forming the cover 5 are the same as those for forming the intermediate layer 3, and therefore a detailed explanation thereof is omitted here.

A method for manufacturing a golf ball having such a structure is explained below. First, a first mold (not shown) having an inner surface corresponding to the outer surface of the core 1 is prepared. The first mold can be disassembled into a plurality of parts so that the grooves 7 are not caught when the core 1 is removed. Second, a material for the core is placed in the mold, and compression molding is conducted at about 140 to 170° C. for 5 to 30 minutes. It is also possible to form the core not only by compression molding but also by injection molding.

Subsequently, the thus formed core 1 is placed in a second mold (not shown). The second mold is formed so that its inner surface has the spherical surface having substantially the same diameter of the core 1. Therefore, when the core 1 is placed in the second mold, the above-described regions 9 contact the inner surface of the mold, and a cavity is formed between each groove 7 and the inner surface. The intermediate layer is formed by placing the material for the intermediate layer in the cavity by injection molding. Exemplary molding conditions are as follows: When an ionomer resin is used as the intermediate layer, it is preferable that the cylinder temperature be 150 to 250° C. and injection pressure be 70 to 100 MPa. When a thermoplastic polyurethane elastomer is used, it is preferable that the cylinder temperature be 170 to 220° C. and injection pressure be 125 to 150 Mpa. The unfinished product in which the intermediate layer 3 has been formed is then removed from the second mold and placed in a third mold (not shown) and a cover 5 is formed thereon by a known injection molding method. It is also possible to form the cover 5 by covering the unfinished product (the core 1 and intermediate layer 3) with a cover-material that has been formed into a pair of hemispherical shells beforehand and then conducting compression molding.

In a golf ball having the above structure, the soft core 1 is covered with the intermediate layer 3 with a hardness greater than the core 1. In this structure, the intermediate layer 3 is formed into band-shapes and covers the surface of the core 1, and portions of the core 1 are exposed through the intermediate layer 3. Therefore, the following effects can be achieved. When the ball is hit by a driver, etc., at high speed, an excessive degree of deformation of the soft core 1 can be prevented by the intermediate layer 3 having a high hardness, so it is possible to improve the ball resilience. In this structure, because a portion of the core 1 reaches the inner surface of the cover 5, a soft impact feel can be achieved. On the other hand, when the ball is hit by a putter, etc., at low speed, because of the small degree of the deformation, the properties of the intermediate layer 3 with a high hardness exert a strong effect, improving the ball resilience. Therefore, the golf ball of the present embodiment can achieve both a high ball resilience and a soft impact feel.

Furthermore, in the golf ball of the present embodiment, because the surfaces of the core 1 and the intermediate layer 3 exist on the same spherical surface, the thickness of the cover 5 covering the core 1 and the intermediate layer 3 is uniform at all portions of the ball surface. Therefore, it is possible to prevent an uneven impact feel due to coexisting thick and thin portions in the cover.

(Second Embodiment)

Hereunder, a golf ball of a second embodiment of the present invention is explained below with reference to drawings. The golf ball of the present embodiment is, as with the first embodiment, a three-piece golf ball; however, the shapes of the core and the intermediate layer covering the core are different from those of the first embodiment.

Figure 4:
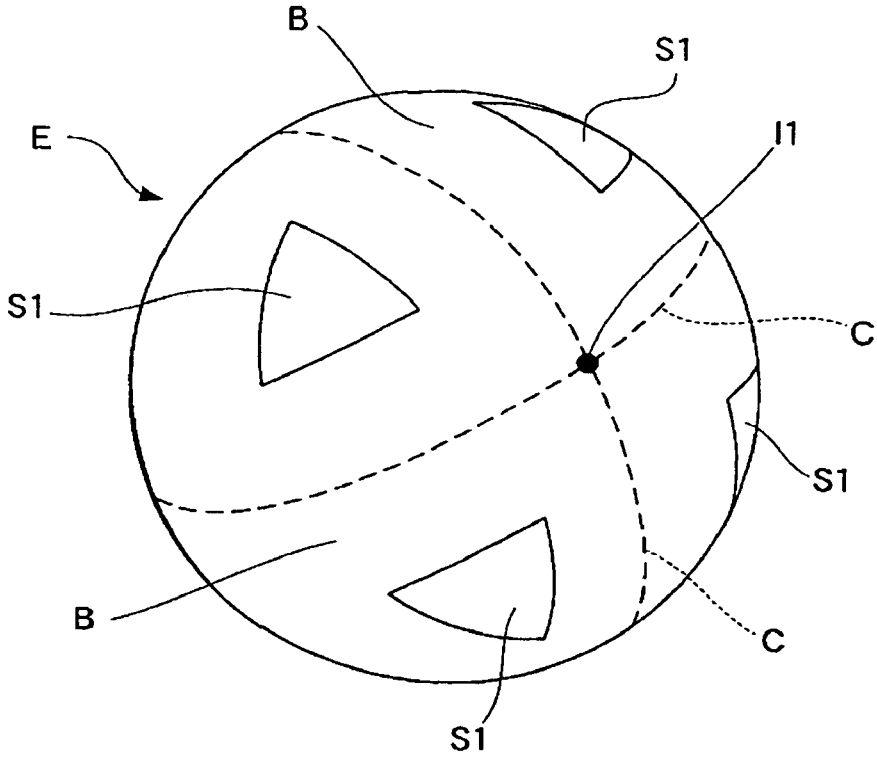
FIG. 4 is a perspective view explaining the shape of the core of a golf ball according to the second embodiment of the present invention.
Figure 5:
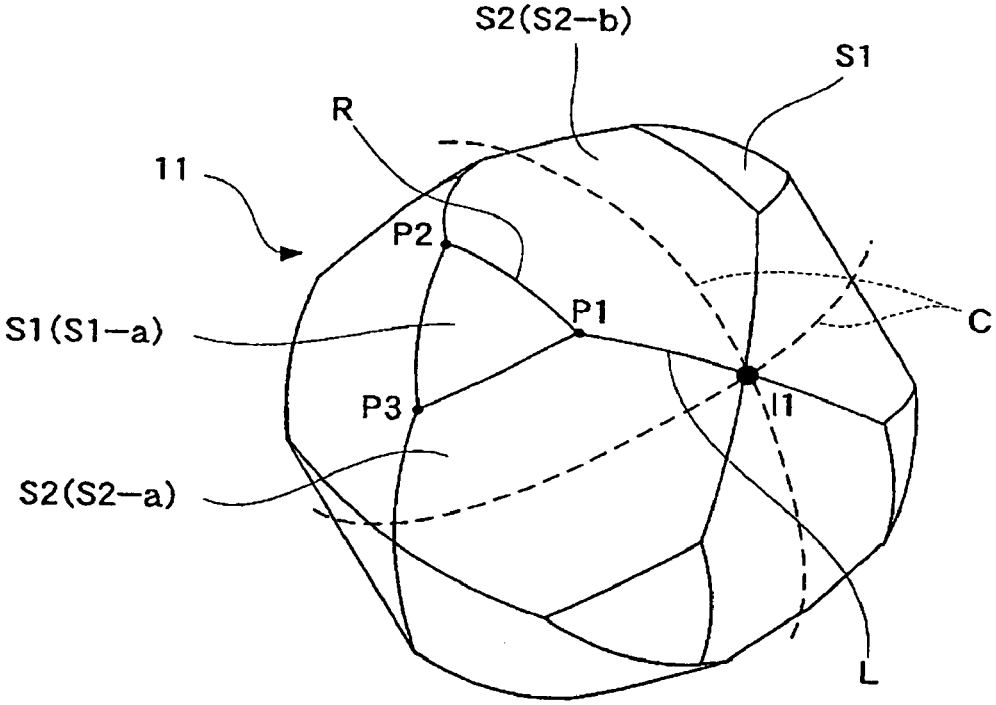
FIG. 5 is a perspective view showing the core of the second embodiment.

The shape of the core is defined as follows: As shown in FIG. 4, three great circles C intersecting each other at right angles are drawn on the surface of a datum sphere E and bands B extend along the great circles C are defined. Here, each region surrounded by bands B is defined as a first surface S1. Each first surface S1 is formed into a triangular shape by three arcs of the same length. Subsequently, as shown in FIG. 5, twelve second surfaces S2 are defined in the portions corresponding to those of the bands B. Each second surface S2 extends between intersections of the great circles C and has a radius of curvature the same as that of the arc R of the first surface S1. The structure shown in FIG. 5 is a core 11 of the present embodiment and is in the form of a polyhedron. The shape of the core is explained in detail below.

Figure 6:
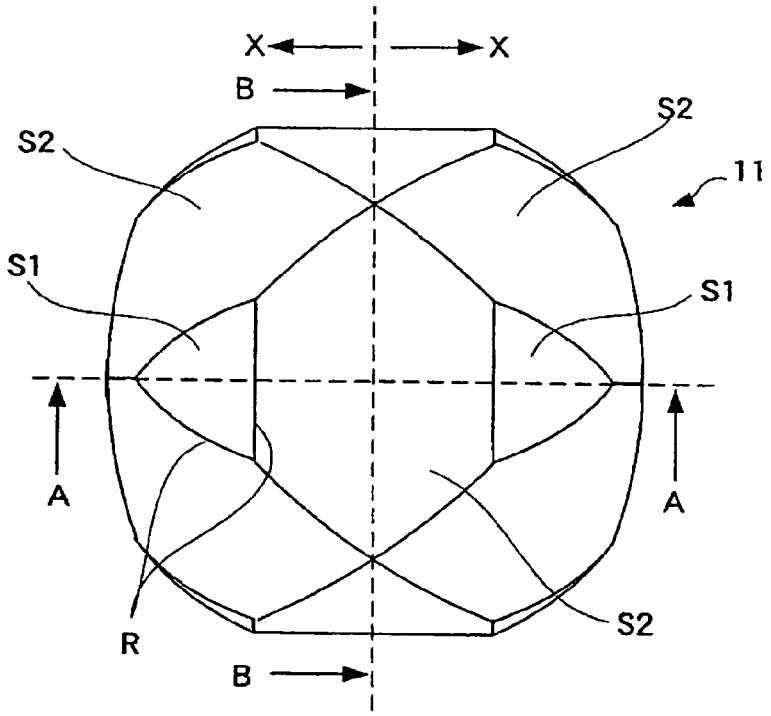
FIG. 6 is a plan view of the core of the second embodiment.
Figure 7:
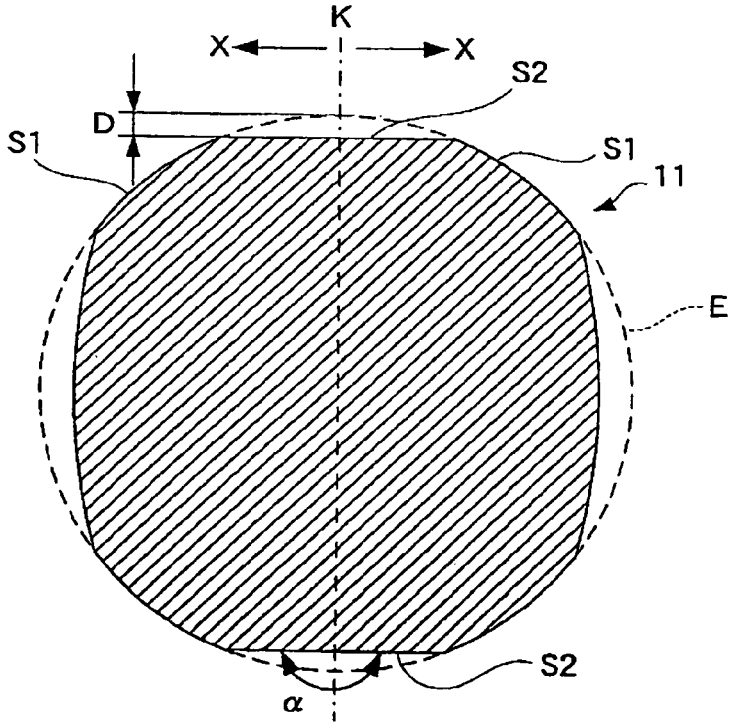
FIG. 7 is a cross-sectional view of FIG. 6 taken along the line A—A.
Figure 8:
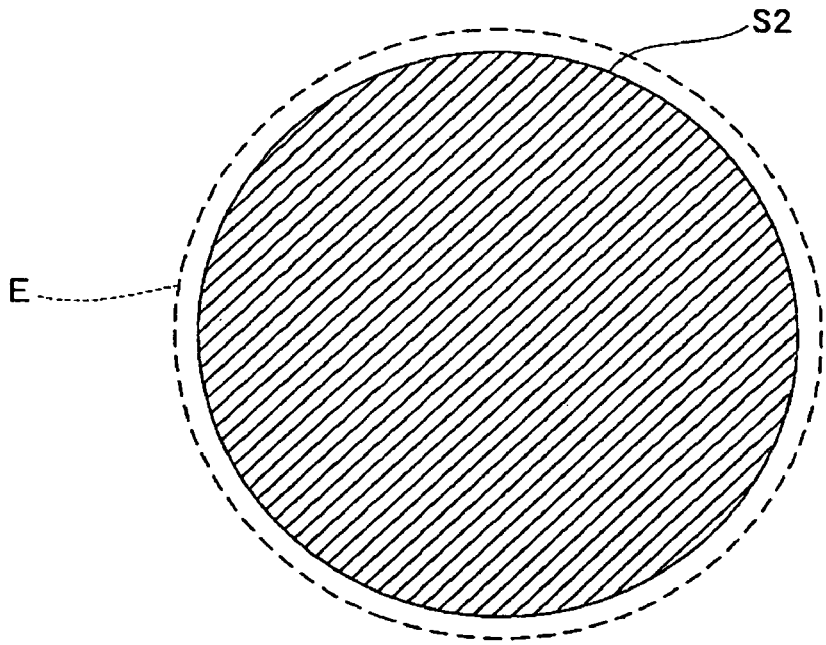
FIG. 8 is a cross-sectional view of FIG. 6 taken along the line B—B.

FIG. 6 is a plan view of the core, FIG. 7 is a cross-sectional view of FIG. 6 taken along the line A—A, and FIG. 8 is a cross-sectional view of FIG. 6 taken along the line B—B. As shown in FIGS. 7 and 8, because the second surface S2 has a radius of curvature the same as that of the arc R of the first surface S1, the surface of the second surface S2 is lower than the surface of the datum sphere E and is depressed relative to the surface of the datum sphere E, forming a concave portion. The concave portion has a flat cross-sectional profile as shown in FIG. 7, and the angle $\alpha$ described in the first embodiment is here 180°. Each second surface S2 contacts an adjacent second surface in the following manner. Explanation is made taking two second surfaces, S2-*a* and S2-*b*, as shown in FIG. 5 as examples.

These second surfaces S2-*a* and S2-*b* meet at an intersection I1 of the great circles, and a first surface S1-*a* is disposed between them. These second surfaces S2-*a* and S2-*b* have a boundary at a line L drawn between the intersection I1 and an apex P1 that is the nearest apex to the intersection I1 of those of the first surface S1-*a*. Each second surface S2 thus forms a hexagon.

Figure 9:
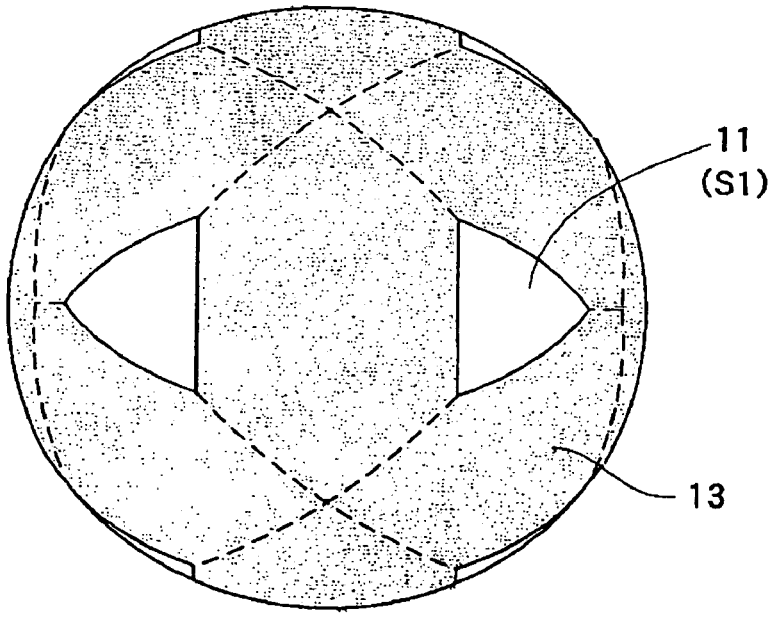
FIG. 9 is a front view showing an unfinished product comprising an intermediate layer covering the core shown in FIG. 6.

FIG. 9 is a plan view showing an unfinished product comprising the core covered with the intermediate, layer. As shown in this figure, the intermediate layer 13 covers the second surface S2 of the core 11. In this structure, the intermediate layer 13 is provided so that the surface thereof and the first surface S1 of the core 11 are formed on the same spherical surface. In other words, in the unfinished product comprising the core 11 covered with the intermediate layer 13, the outer surface thereof is coincident with the datum sphere E (see FIG. 4). The thickness of the intermediate layer 13 corresponds to the distance D from the second surface S2 of the core 11 to the datum sphere E in the radial direction as shown in FIG. 7. The portions in the intermediate layer 13 through which the core 11 is exposed are apertures of the present invention.

Figure 10:
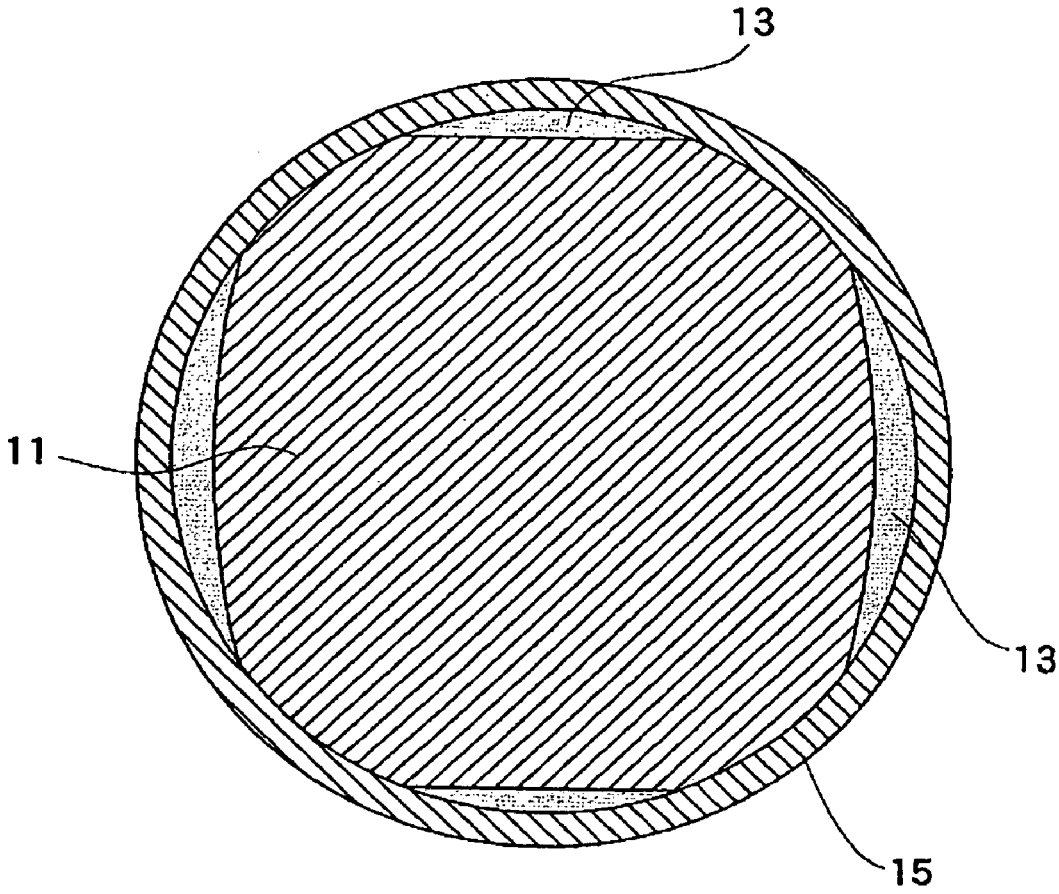
FIG. 10 is a plan view of a golf ball according to the second embodiment.

A cover 15 is provided over the unfinished product, and a golf ball as shown in FIG. 10 is thus obtained. The maximum diameter (measured having the first surface S1 as a reference), materials and hardness of the core 11 are the same as those in the first embodiment, and therefore a detailed explanation thereof is omitted, and the same applies to the intermediate layer 13 and the cover 15.

A method for manufacturing a golf ball having such a structure is explained below. First, a first mold (not shown) for producing a core 11 is prepared. This mold is so formed that its inner surface corresponds to the outer surface of the core 11. This mold comprises two portions, i.e., an upper part and a lower part, and can be split in half. Here, all that is necessary is that the parting line between the upper part and the lower part of the mold is in a plane that passes along any one of the great circles C, for example, the line B—B as shown in FIG. 6 or the line K in FIG. 7.

Using such a first mold, after placing a material for the core in the lower part of the mold, the upper part of the mold and the lower part of the mold are joined, and the core is formed by compression molding at about 140 to 170° C. for 5 to 30 minutes. The upper part of the mold and the lower part of the mold are then separated from each other and the molded core 1 is removed. Because the inner surface of the mold is formed so as to correspond to the shape of the core 1 as described above and the upper part of the mold and the lower part of the mold are separated from each other in the directions shown by arrows X in FIGS. 6 and 7, it is readily possible to remove the core 1 from the mold without being caught therein. Subsequently, the removed core 11 is placed in a second mold (not shown) for the intermediate layer and the cover 15 is formed by injection molding or compression molding. The second mold is similar to that used in the first embodiment. In other words, the second mold has a spherical inner surface that contacts the first surface of the core 11. After placing the core 11 in the second mold (not shown), the intermediate layer 13 is formed over the core 11 by injection molding under the same conditions as in the first embodiment. The thus obtained unfinished product is placed in a third mold (not shown), and a cover 15 is provided by injection molding. As in the first embodiment, it is also possible to provide the cover 15 by compression molding.

As described above, in the present embodiment, because the depressed second surfaces S2 are formed in the surface of the soft core 11 and the intermediate layer 13 having a great hardness covers these portions, the same effects as in the first embodiment can be obtained. In other words, it is possible to achieve both a high ball resilience and soft feel in the same golf ball. Even though depressed portions such as the second surfaces S2 (concave portions) exist in the core 11, the core 11 has a polyhedral-shape as a whole. Therefore, regardless of the point hit, the degree of deformation does not greatly vary. It is possible to transfer the energy generated by impact more smoothly than in cases in which grooves are formed, reducing the variation in carry distance.

Furthermore, because the core 11 has the shape as described above, it is possible to form the core 11 using a mold that can be split in half, i.e., an upper part and lower part. In other words, by forming the second surfaces S2, which correspond to the grooves in the first embodiment, into the above-described shape, it is possible to smoothly remove the core 11 even when a mold that can be split in half is used. As a result, it is possible to reduce production time of the core 11 and the cost of the mold. This makes it possible to mass-produce the core 11 at low cost.

Embodiments of the present invention are described above; however, the present invention is not limited to the above embodiments and various modifications can be made as long as they do not depart from the scope of the invention. For example, in the first embodiment, the grooves (concave portions) have a V-shaped cross-sectional profile; however, the shapes of the grooves are not limited to this and may, for example, have an arc-shaped or rectangular-shaped cross-sectional profile.

Figure 11:
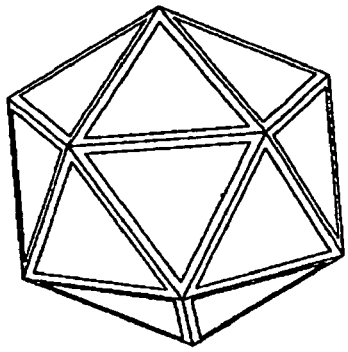
FIG. 11 shows an unfinished product of a golf ball of another example of the present invention.
Figure 11:
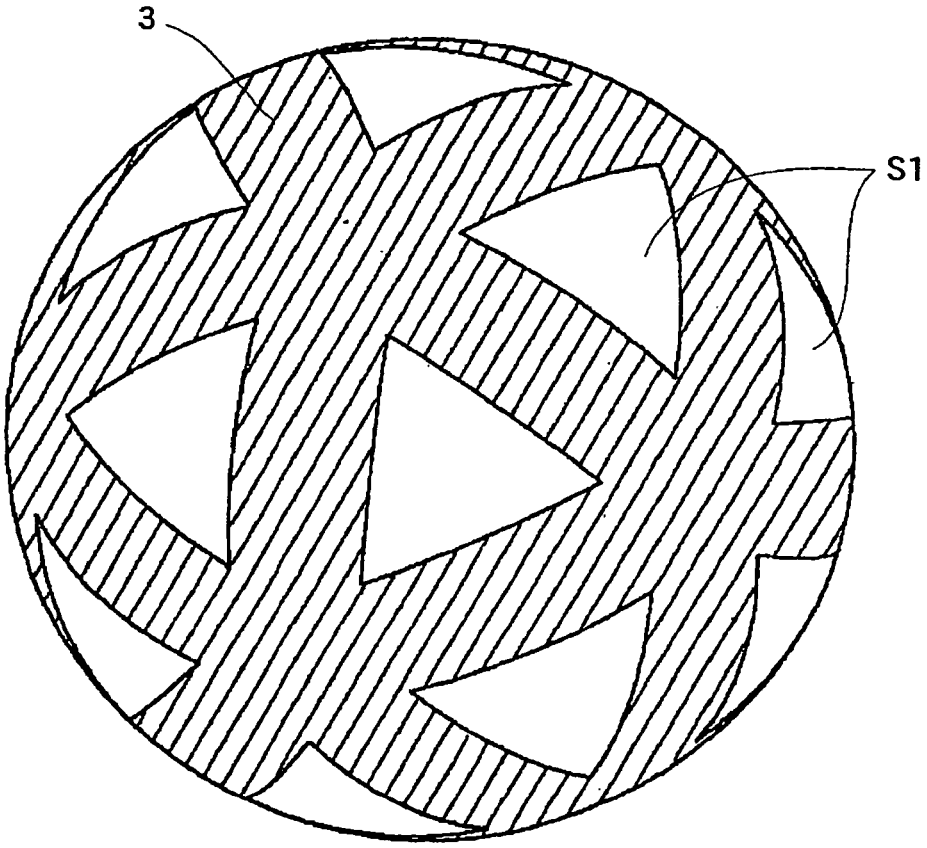

In the first embodiment, the grooves are formed along great circles on the core; however, the structure thereof is not limited to this as long as the grooves are formed so as to partition the surface of the core into a plurality of regions. However, it is preferable that the portions correspond to the above-described apertures, i.e., the portions in the core exposed through the intermediate layer, be arranged point symmetrically relative to the center of the core. This reduces the variation in carry distance. An example of such a core is shown in FIG. 11. In this example, the core is formed using a regular icosahedral structure as shown in FIG. 11(*a*). Each surface of the regular icosahedral structure is projected onto a datum sphere E as described in the second embodiment to define the first surfaces S1, and the portions where each surface of the regular icosahedral structure are not projected are defined as the second surfaces which are covered by the intermediate layer. The second surfaces may have a V-shaped cross-sectional profile as in the grooves of the first embodiment, or they may form recessed portions as in the second embodiment. When the thus formed core is covered by the intermediate layer 3, an unfinished product as shown in FIG. 11(*b*) is obtained.

In the above embodiments, the angle made by the concave portion is an acute angle or 180°; however, as long as the concave portion is formed as depressed from the referral spherical surface, the angle may be obtuse.

In the above embodiments, the hardness of the cover 5 is greater than that of the core 1 and less than that of the intermediate layer 3, it is also possible to make the hardness of the cover 5 less than that of the core 1, i.e., in such a manner that the hardness lessens in the order of the intermediate layer 3, core 1 and cover 5. This arrangement makes the impact feel further softer and improves spin performance.

The structure that eases the removal of the core from the mold is not limited to that of the second embodiment. As long as it is so structured that, when any plane that passes along one of the great circles of the core is defined, the surface of the core with which the intermediate layer is in contact extends perpendicular to the plane or outward in the radial direction as it approaches the plane, the core can be removed from the mold without being caught therein.

EXAMPLES

Hereunder, Examples and Comparative Examples of the present invention are described. With regard to two-piece golf balls, eleven types golf balls of the present invention (Examples 1 to 11) and two other types of golf balls (Comparative Examples 1 to 2) were prepared. The golf balls of Examples 1 to 11 and Comparative Examples 1 to 2 comprise a core, an intermediate layer and a cover formed from the materials having the constituents shown in Tables 1 and 2 below. Specifically, four different materials a to d for which the ratios of constituents are shown in Table 1 were used for manufacturing the core. Five different materials A to E as shown in Table 2 were used for manufacturing the intermediate layer and cover.

TABLE 1

<Ratio of constituents of the core material>

| | Parts by weight | | | |
|---|---|---|---|---|
| | a | b | c | d |
| BR-11 (manufactured by JSR Corporation) | 100 | 100 | 100 | 100 |
| Zinc acrylate | 26 | 26 | 36 | 36 |
| Zinc oxide | 5 | 5 | 5 | 5 |
| Barium sulfate | 24 | 10 | 5 | 2 |
| Dicumyl peroxide | 1 | 1 | 1 | 1 |
| Antioxidant | 0.1 | 0.1 | 0.1 | 0.1 |
| Shore D hardness | 45 | 45 | 54 | 54 |

TABLE 2

<Ratio of constituents of the materials for the intermediate layer and cover>

| Type | Material | Parts by weight | Shore D hardness |
|---|---|---|---|
| A | HIMILAN 1855 | 50 | 56 |
| | HIMILAN 1555 | 50 | |
| B | HIMILAN 1605 | 50 | 62 |
| | HIMILAN 1705 | 50 | |
| C | Elastollan ET858D | 100 | 57 |
| D | Elastollan ET858D | 50 | 52 |
| | Elastollan ET890 | 50 | |
| E | Elastollan ET858D | 40 | 50 |
| | Elastollan ET890 | 60 | |

(*Himilan is a trademark registered by Du Pont-Mitsui Polychemicals Co., Ltd., and Elastollan is a trademark registered by BASF Japan Ltd.)

The structure, size, etc., of golf balls in each Example and Comparative Example are as shown in Table 3. The golf balls of Examples 1 to 3, 5 and 6 were structured so as to have an angle α of 180°, i.e., the structure described in the second embodiment. The golf ball of Example 4 had the structure as in the first embodiment with the angle α being acute (160°).

In Example 7, golf balls having shallow concave portions in the structure of the second embodiment were used. In Example 8, golf balls having deep concave portions in the structure of the first embodiment were used. The golf balls of Example 9 had a structure wherein the angle α was an obtuse angle to decrease the area ratio of the core exposed through the intermediate layer. The structure of the golf balls of Example 10 was such that the above-mentioned area ratio was increased in the arrangement of the first embodiment. In Example 11, golf balls in the arrangement of the second embodiment were so structured that the hardness of the cover was increased.

In Comparative Example 1, a structure according to the second embodiment wherein the hardness of the intermediate layer was lower than that of the core was employed. The golf balls of Comparative Example 2 were two-piece golf balls having no intermediate layers nor concave portions on the core.

In the above-described Examples 1 to 11 and Comparative Examples 1 and 2, the materials for the core, intermediate layer and cover, and their hardnesses are as shown in Table 4. Symbols a to d and A to E in Table 4 are the same as those in Tables 1 and 2.

TABLE 3

<Size>

| | Concave portion | Maximum diameter of the core (mm) | Depth of the concave portion (mm) | Proportion of the are of the core (%) | Angle α (°) | Thickness of the Cover (mm) |
|---|---|---|---|---|---|---|
| Ex. 1 | Provided | 39.3 | 1.0 | 25 | 180 | 1.7 |
| Ex. 2 | Provided | 39.3 | 1.5 | 15 | 180 | 1.7 |
| Ex. 3 | Provided | 39.3 | 1.7 | 12 | 180 | 1.7 |
| Ex. 4 | Provided | 39.3 | 1.0 | 50 | 160 | 1.7 |
| Ex. 5 | Provided | 39.9 | 1.5 | 15 | 180 | 1.4 |
| Ex. 6 | Provided | 40.3 | 1.5 | 15 | 180 | 1.2 |
| Ex. 7 | Provided | 39.3 | 0.9 | 28 | 180 | 1.7 |
| Ex. 8 | Provided | 39.3 | 1.8 | 31 | 160 | 1.7 |
| Ex. 9 | Provided | 39.3 | 1.7 | 7 | 185 | 1.7 |
| Ex. 10 | Provided | 39.3 | 1.0 | 55 | 150 | 1.7 |
| Ex. 11 | Provided | 39.3 | 1.5 | 15 | 180 | 1.7 |
| Comp. Ex. 1 | Provided | 40.3 | 1.5 | 15 | 180 | 1.2 |
| Comp. Ex. 2 | Not provided | 39.3 | — | — | — | 1.7 |

TABLE 4

<Material and hardness>

| | Core material | Intermediate layer material | Cover material |
|---|---|---|---|
| Example 1 | a (45) | B (62) | A (56) |
| Example 2 | a (45) | B (62) | A (56) |
| Example 3 | a (45) | B (62) | A (56) |
| Example 4 | a (45) | B (62) | A (56) |
| Example 5 | b (45) | B (62) | C (57) |
| Example 6 | c (54) | B (62) | D (52) |
| Example 7 | a (45) | B (62) | A (56) |
| Example 8 | a (45) | B (62) | A (56) |
| Example 9 | a (45) | B (62) | A (56) |
| Example 10 | a (45) | B (62) | A (56) |
| Example 11 | a (45) | A (56) | B (62) |
| Comparative Example 1 | d (54) | D (52) | E (50) |
| Comparative Example 2 | b (45) | — | A (56) |

(* numbers in brackets show Shore D hardness)

Using the golf balls obtained in the Examples and Comparative Examples described above, hitting tests were conducted using a hitting robot (manufactured by Miyamae Co., Ltd.: product name "SHOT ROBO V") with a No. 1 Wood (1W: Mizuno Corporation; Mizuno 300S-II 380, loft angle: 9°, length: 44.75 inches (113.66 cm), shaft flex: S). The head speed of the 1W was set at 43 m/s. Tests of the feeling when hit were conducted by ten amateurs using a 1W. The ten amateurs were asked to select one of (1: soft, 2: slightly soft, 3: excellent, 4: slightly hard, 5: hard) as the evaluation criteria of feeling when hit and the average value of those selected was defined as the feeling value of each example. Table 5 shows the results.

TABLE 5

<Test results>

| | Carry distance (m) | Feeling value |
|---|---|---|
| Example 1 | 198.5 | 2.8 |
| Example 2 | 200.4 | 2.9 |
| Example 3 | 200.6 | 3.0 |
| Example 4 | 199.1 | 2.8 |
| Example 5 | 198.1 | 2.8 |
| Example 6 | 197.4 | 2.7 |
| Example 7 | 193.2 | 2.8 |
| Example 8 | 199.2 | 3.9 |
| Example 9 | 200.9 | 4.2 |
| Example 10 | 194.3 | 2.6 |
| Example 11 | 197.8 | 4.1 |
| Comparative Example 1 | 193.5 | 2.4 |
| Comparative Example 2 | 192.4 | 2.1 |

As is clear from Table 5, golf balls of Examples 1 to 6 exhibit sufficient carry distance and excellent impact feel. Because the ball of Example 7 had shallow concave portions and a thin intermediate layer, although the impact feel was excellent, the carry distance was shorter than those of Examples 1 to 6. Because of its deep concave portions and thick intermediate layer, the golf ball of Example 8 exhibited an excellent carry distance but its impact feel was harder than Examples 1 to 6.

In Example 9, because the area of the core exposed through the intermediate layer was small, excellent carry distance was obtained but the impact feel was hard. In Example 10, because the area of the core exposed through the intermediate layer was large, the impact feel was excellent but the carry distance was shorter than Examples 1 to 6.

In Example 11, because a hard cover was used, the carry distance was satisfactory but the impact felt harder than Examples 1 to 6.

In contrast, because the golf balls of Comparative Example 1 had an intermediate layer whose hardness was lower than that of the core, when compared to Example 6 which has a similar structure, the carry distance was significantly reduced regardless of the fact that the hardness of the core was the same.

Because a hard intermediate layer was not provided in Comparative Example 2, the carry distance was further shortened compared to Comparative Example 1.

As is clear from the above-described Examples and Comparative Examples, the present invention can provide a golf ball that can achieve a long carry distance and excellent impact feel.

The invention claimed is:

1. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein the plurality of apertures are formed substantially symmetrically relative to the center of the core, wherein the intermediate layer comprises bands of substantially the same width extending along three great circles intersecting each other at right angles on the surface of the core, the apertures are surrounded by the bands and formed into a triangular shape.

2. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein, when any plane that passes along one of three great circles of the core is defined, the surface of the core with which the intermediate layer is in contact extends perpendicular to the plane or outward in the radial direction as it approaches the plane.

3. A golf ball according to claim 1, wherein the surface of the core comprises eight first surfaces exposed through the apertures, and twelve second surfaces extending between intersections of the three great circles, each first surface is formed into a regular triangular shape bounded by arcs having substantially the same length, each second surface extending between intersections of the great circles has the same radius of curvature as the arcs, and two of the second surfaces meet each other at an intersection at right angles and have a boundary between the first surface along a line from the intersection to an apex of the first surface nearest to the intersection.

4. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein the hardness of the cover is less than that of the intermediate layer and greater than that of the core.

5. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein the hardness of the cover is less than that of the core.

6. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein the thickest portion of the intermediate layer has a thickness of 1.0 to 1.7 mm.

7. A golf ball comprising a core, intermediate layer and cover, wherein the intermediate layer is provided with a plurality of apertures through which the core is exposed, the outer surface of the intermediate layer and the surface of the core exposed through the apertures exist on substantially the same spherical surface, and the hardness of the intermediate layer is greater than that of the core, wherein of the spherical surface including the surface of the intermediate layer, the proportion of the core surface exposed through the apertures is 10 to 50%.

* * * * *